US009033153B2

(12) United States Patent
Lambalot et al.

(10) Patent No.: US 9,033,153 B2
(45) Date of Patent: May 19, 2015

(54) TAMPER-EVIDENT PACKAGE

(75) Inventors: Ralph H. Lambalot, Wrentham, MA (US); Arlene F. Limanek, Sutton, MA (US)

(73) Assignee: Abbvie Inc., North Chicago, IL (US)

( * ) Notice: Subject to any disclaimer, the term of this patent is extended or adjusted under 35 U.S.C. 154(b) by 467 days.

(21) Appl. No.: 13/368,781

(22) Filed: Feb. 8, 2012

(65) Prior Publication Data

US 2012/0222980 A1 Sep. 6, 2012

Related U.S. Application Data

(60) Provisional application No. 61/440,661, filed on Feb. 8, 2011.

(51) Int. Cl.

| | |
|---|---|
| ***B65D 83/04*** | (2006.01) |
| ***B65D 85/00*** | (2006.01) |
| ***B65D 55/08*** | (2006.01) |
| ***B65D 51/18*** | (2006.01) |
| ***B65D 55/14*** | (2006.01) |
| ***B65D 63/10*** | (2006.01) |

(52) U.S. Cl.

CPC ..... *B65D 55/08* (2013.01); *B65D 51/18* (2013.01); *B65D 55/14* (2013.01); *B65D 63/10* (2013.01); *B65D 2255/00* (2013.01); *Y10S 206/807* (2013.01)

(58) Field of Classification Search

USPC ..... 206/459.1, 528, 807, 540; 53/467; 70/164; 215/251, 253, 257, 277, 278; 220/254.1, 254.7, 254.8, 256.1, 257.1, 220/259.3

See application file for complete search history.

(56) References Cited

U.S. PATENT DOCUMENTS

| | | | | |
|---|---|---|---|---|
| 1,732,952 | A | 10/1929 | Stengel | |
| 1,832,057 | A * | 11/1931 | Stein | 70/164 |
| 4,271,972 | A * | 6/1981 | Thor | 215/251 |
| 4,520,942 | A * | 6/1985 | Dwinell | 220/257.2 |
| 5,012,941 | A * | 5/1991 | Abrams et al. | 215/250 |
| 5,348,180 | A * | 9/1994 | Shepard | 220/214 |
| 5,996,833 | A * | 12/1999 | Lencioni et al. | 220/257.2 |
| 6,655,553 | B2 * | 12/2003 | Staniszewski et al. | 222/153.07 |
| 6,692,045 | B1 * | 2/2004 | McCall, Jr. | 292/281 |
| 7,222,741 | B2 * | 5/2007 | Chmela et al. | 220/257.1 |
| 2009/0120934 | A1 * | 5/2009 | Domkowski | 220/253 |

FOREIGN PATENT DOCUMENTS

| | | |
|---|---|---|
| GB | 276 572 A | 9/1927 |
| WO | WO 2009/032038 | 3/2009 |

OTHER PUBLICATIONS

International Search Report and Written Opinion for PCT/US2012/024304, dated May 7, 2012.

* cited by examiner

*Primary Examiner* — Luan K Bui

(74) *Attorney, Agent, or Firm* — Lathrop & Gage LLP; Andrew T. Wilkins, Esq.

(57) ABSTRACT

Tamper-evident package comprises a container, a primary cap, and a secondary cap. The container comprises a sidewall defining a chamber and a rim defining a mouth to the chamber. The primary cap is removably-attachable to the rim of the container to selectively close the mouth of the container. The secondary cap is positioned over the primary cap to prevent removal of the primary cap when positioned thereover. The secondary cap includes a single-use lock, such as a cable tie, to secure the secondary cap in position over the primary cap. The package thus provides evidence that someone has tampered with or attempted to tamper with the container if the single-use lock is removed or damaged. Method of using the tamper-evident package is also disclosed.

14 Claims, 6 Drawing Sheets

TAMPER-EVIDENT PACKAGE

CROSS-REFERENCE TO RELATED APPLICATION

This application claims priority to U.S. Provisional Application Ser. No. 61/440,661, filed Feb. 8, 2011, the disclosure of which is hereby incorporated by reference in its entirety.

BACKGROUND OF THE INVENTION

1. Field of the Invention

The present application generally relates to a tamper-evident package. Particularly, the present application relates to a tamper-evident package including a secondary cap having a single-use lock.

2. Description of Related Art

Both consumers and suppliers have become increasingly aware of the likelihood and risks associated with tampering of packages. These risks and challenges may be particularly acute in the health sector.

Tampering of packages generally is more likely to occur during shipping and/or storage of consumer goods when packages are not closely monitored. A number of tamper-evident packages have been developed to address this increasing occurrence. Generally, such conventional packages include a removable cap disposed over a seal membrane or the like. However, a large number of tamper-evident devices, such as pressurized or sealed containers, are designed so that the ingress can only be detected after opening of the container. Therefore, it can be difficult for the supplier and the consumer to detect products that have been tampered with prior to a sale.

Therefore, there is a need for a tamper-evidence device to prevent access to removable caps and underlying seals, and that clearly indicates to suppliers and consumers whether a container has been tampered or opened.

SUMMARY OF THE INVENTION

The purpose and advantages of the present application will be set forth in and apparent from the description that follows, as well as will be learned by practice of the disclosed subject matter. Additional advantages of the disclosed subject matter will be realized and attained by the apparatus particularly pointed out in the written description and claims hereof, as well as from the appended drawings.

To achieve these and other advantages and in accordance with the purpose of the application, as embodied and broadly described, the disclosed subject matter includes a container, a primary cap, and a secondary cap. The container can include, but is not limited to, a sidewall defining a chamber and a rim defining a mouth to the chamber. The primary cap is removably-attachable to the rim of the container to selectively close the mouth of the container. The secondary cap can be positioned over the primary cap to prevent removal of the primary cap when positioned thereover. The secondary cap includes, but is not limited to, a single-use lock to secure the secondary cap in position over the primary cap.

In accordance with one embodiment of the disclose subject matter, the container is a bottle. Furthermore, the rim of the container can include a fastener extending outwardly from the rim for removable attachment of the primary cap. The fastener can be, for example, a threaded fastener. The single-use lock can be, for example, a cable tie.

In accordance with another embodiment, the secondary cap can include a strap extending therefrom to secure the secondary cap to the container. For example, the strap has a length sufficient to extend about a perimeter of the rim and can be secured thereto by the single-use lock. The strap can include a first aperture to receive the single-use lock. The strap can further include a second aperture aligned with the first aperture when the strap is extended securely about the rim to receive the single-use lock therethrough.

In accordance with another embodiment, the strap can include a first free end portion with the first aperture therein and a second end portion with a second aperture therein. The secondary cap further includes an intermediate portion with a third aperture therein. The first, second, and third apertures spaced to be aligned with each other when the strap is extended securely about the rim to receive the single-use lock therethrough.

The present application also provides a method of packaging a product in a tamper-evident manner. The product is disposed within a container and the mouth of the container is closed with a primary cap which is removably-attachable to the rim of the container. The secondary cap is positioned over the primary cap to prevent removal of the primary cap and secured in position over the primary cap using a single-use lock. The product can include, but is not necessarily limited to, health care product such as a pharmaceutical, biological, or nutritional product. The health care product can be in the form of pills, capsules, tablets, solid crystals, powders, liquids, or the like. The single-use lock can be, but is not limited to, a cable tie.

It is to be understood that both the foregoing general description and the following detailed description are exemplary and are intended to provide further explanation of the application claimed.

The accompanying drawings, which are incorporated in and constitute part of this specification, are included to illustrate and provide a further understanding of the apparatus of the application. Together with the written description, the drawings serve to explain the principles of the application.

DETAILED DESCRIPTION OF THE PREFERRED EMBODIMENT

Reference will now be made in detail to the present preferred embodiments of the disclosed subject matter, examples of which are illustrated in the accompanying drawings. The packages presented herein generally are intended for providing a secure tamper-evident closure for the storage and shipment of sensitive materials, although other similar or suitable uses are contemplated. In accordance with the disclosed subject matter, a package having a tamper-evident feature is provided. The package includes a container, a primary cap, and a secondary cap. The container has a sidewall defining a chamber and a rim defining a mouth to the chamber. The primary cap is removably-attachable to the rim of the container to selectively close the mouth of the container. The secondary cap is positioned over the primary cap to prevent removal of the primary cap when positioned thereover, the secondary cap having a single-use lock to secure the secondary cap in position over the primary cap.

Likewise, and in accordance with another aspect of the disclosed subject matter, a method is provided for packaging a product in a tamper-evident manner. The method comprises disposing a product within a container, closing the mouth of the container with a primary cap, positioning the secondary cap over the primary cap to prevent removal of the primary cap, and securing the secondary cap in position over the primary cap. The container has a sidewall defining a chamber and a rim defining a mouth to the chamber. The primary can is removably-attachable to the rim of the container. A single-use lock is used to secure the secondary cap in position over the primary cap. For purposes of understanding, the method will be described in conjunction with the package hereinafter.

For purpose of explanation and illustration, and not limitation, an exemplary embodiment of the package in accordance with the application is shown in FIGS. 1 through 6.

Figure 1:
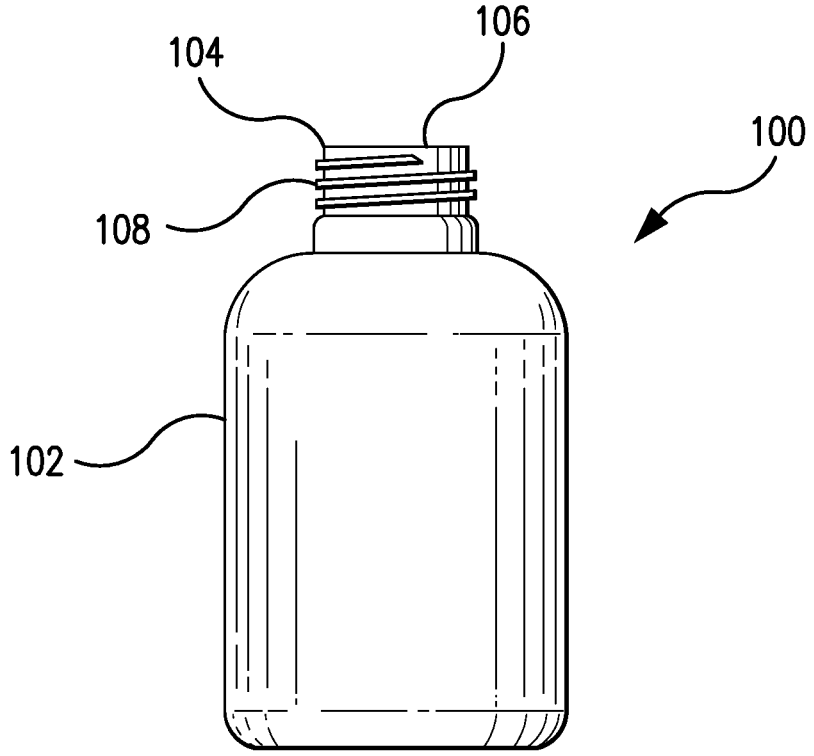
FIG. 1 is a front view of a representative embodiment of a container in accordance with the disclosed subject matter.

With reference to FIG. 1, the container 100 comprises a sidewall 102 and a rim 104. As shown in the exemplary embodiment, container 100 is a bottle such as a bulk drug substance bottle. The container in accordance with the disclosed subject matter can also be a vial, a jar, a can, a flask, a jug or any other suitable container. The container can be rectangular, round or any other desired shape. In general, the container can be any storage vessel to which a cap may be removably-attached.

The container is made of a suitable material for storing a product. For example, if the product to be disposed in the container is pharmaceutical tablets, the container can be made out of a suitable material for storing the pharmaceutical tablets. The material may also be chosen to suit a particular need. For example, if the product needs to be frozen, the container can be made of a material that can withstand freezing. In an exemplary embodiment, the container 100 can be made of a plastic. Likewise, the container can be clear or opaque. More generally, the container in accordance with the disclosed subject matter can be made of any suitable material for its intended purpose as known in the art. Examples of materials include polystyrene, polypropylene, polyethylene terephthalate (PET), polycarbonate, glass, and metals.

Sidewall 102 defines a chamber. The container can be a single-walled construction, or can be provided with a multi-wall construction if desired, such as for insulation or the like. The container 100 further comprises a rim 104 defining a mouth 106 of the chamber. The chamber is the interior of the container. More generally, the chamber is the area enclosed when the primary cap is attached to the rim of the container to selectively close the mouth 106 to the chamber. The chamber can be of any suitable size for the intended contents. However, the minimum size of the chamber will generally be defined by the amount of product to be stored therein. For example, where the container is designed to store one hundred tablets, the chamber should have a sufficient volume to store at least the one hundred tablets.

The mouth 106 of the container 100 is used to insert the product into and remove the product from the container. As such, the shape and size of the mouth 106 will generally be defined by the product to be stored in the container 100. For example, where the container 100 is designed to store tablets, the size and shape of the mouth 106 should be sufficient to receive and dispense at least one tablet at a time.

The container 100 can also include a fastener 108 on rim 104 to releasably attach the primary cap thereto. In an exemplary embodiment, the rim 104 includes a fastener 108 extending outwardly from the rim 104. The fastener 108 receives a mating fastener of the primary cap in order to removably attach the primary cap to the container 100. The fastener 108 can be a threaded fastener or any other fastener for its intended purpose as known in the art. While the fastener 108 shown in FIG. 1 is located on the outside of the rim, the fastener can alternatively be located on the inside of the rim. Moreover, the container 100 can have no fastener if the primary cap can be removably attached to the container 100 without the fastener.

Figure 2:
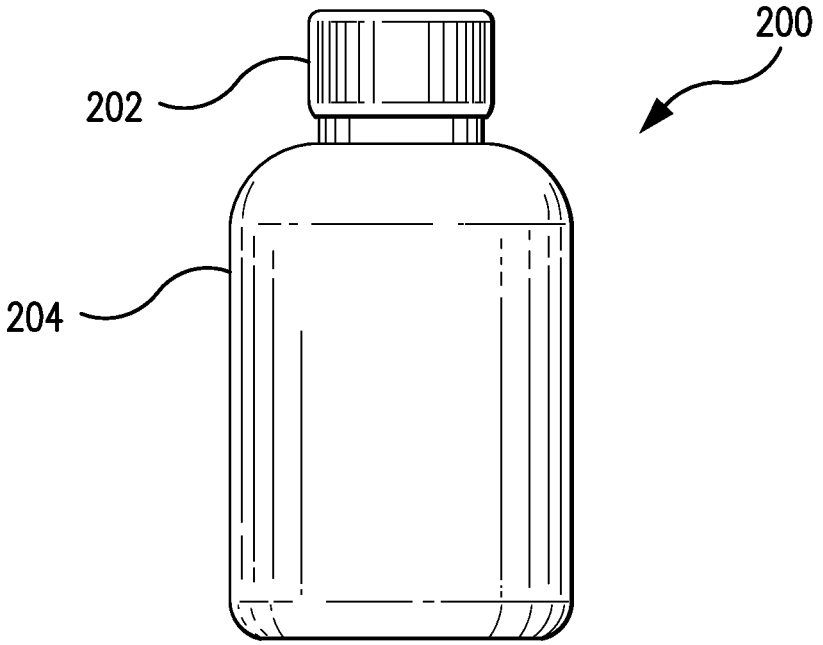
FIG. 2 is a front view of the container shown in FIG. 1 with a representative embodiment of a primary cap in accordance with the disclosed subject matter.

With reference to FIG. 2, a primary package 200 is formed by a removably-attachable primary cap 202 and a container 204. The primary cap 202 can be attached to the container 204 via the fasteners 108 from FIG. 1. In one embodiment, the primary cap 202 is a screw cap with an internal threaded fastener to mate with a threaded fastener on the rim. In another exemplary embodiment, the primary cap 202 is a child proof cap as known in the art. In general, the primary cap can be any suitable cap for its intended purpose as known in the art.

The primary cap 202 can be made from the same or different material as the container 204. The primary cap in accordance with the disclosed subject matter can be made of any suitable material for its intended purpose as known in the art. Examples of materials include polystyrene, polypropylene, polyethylene terephthalate (PET), polycarbonate, glass, and metals.

Figure 3:
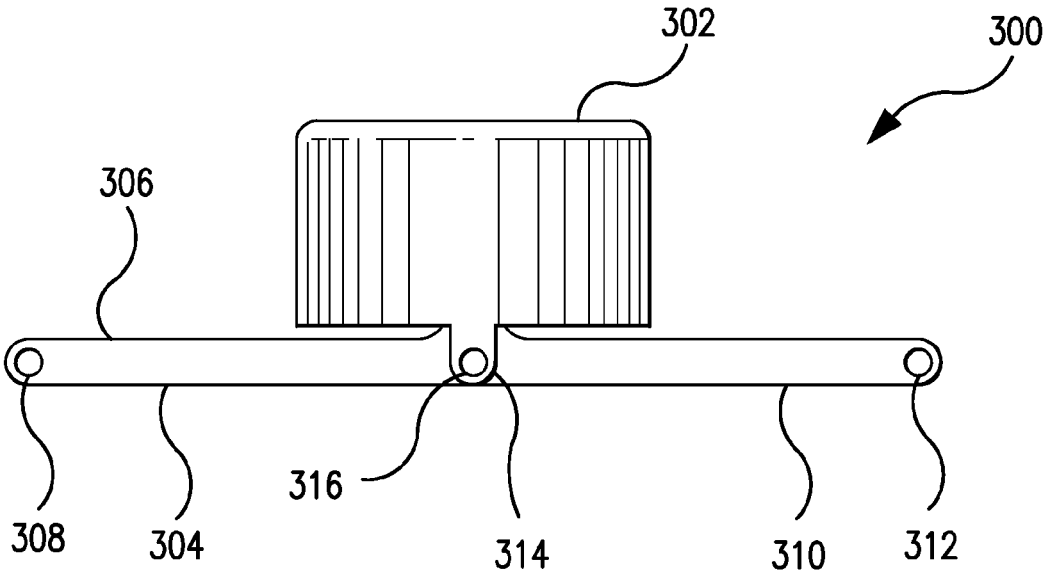
FIG. 3 is a front view of a representative embodiment of a secondary cap in accordance with the disclosed subject matter.

FIG. 3 illustrates an exemplary embodiment of the secondary cap 300 of the disclosed subject matter. For example, and not limitation, the secondary cap 300 includes a cover 302 to be positioned over the primary cap and secured to the container to prevent removal of the primary cap.

The secondary cap can be rectangular, round, or any other desired shape. The secondary cap should be sized and shaped to be positioned over the primary cap and prevent the removal thereof. Preferably, the secondary cap can be made of plastic. However, the secondary cap in accordance with the disclosed subject matter can be made of any suitable material for its intended purpose as known in the art. Examples of materials include polystyrene, polypropylene, polyethylene terephthalate (PET), polycarbonate, glass, and metals. The material can be chosen to meet certain requirements for the storage of the product to be stored in the package. For example, certain products are freeze-thawed for transportation and/or storage. Therefore, the secondary cap can be made of a material that is stable to freeze-thaw. Moreover, the secondary cap can be made of a material that can be handled during the shipping process without degradation.

Figure 4:
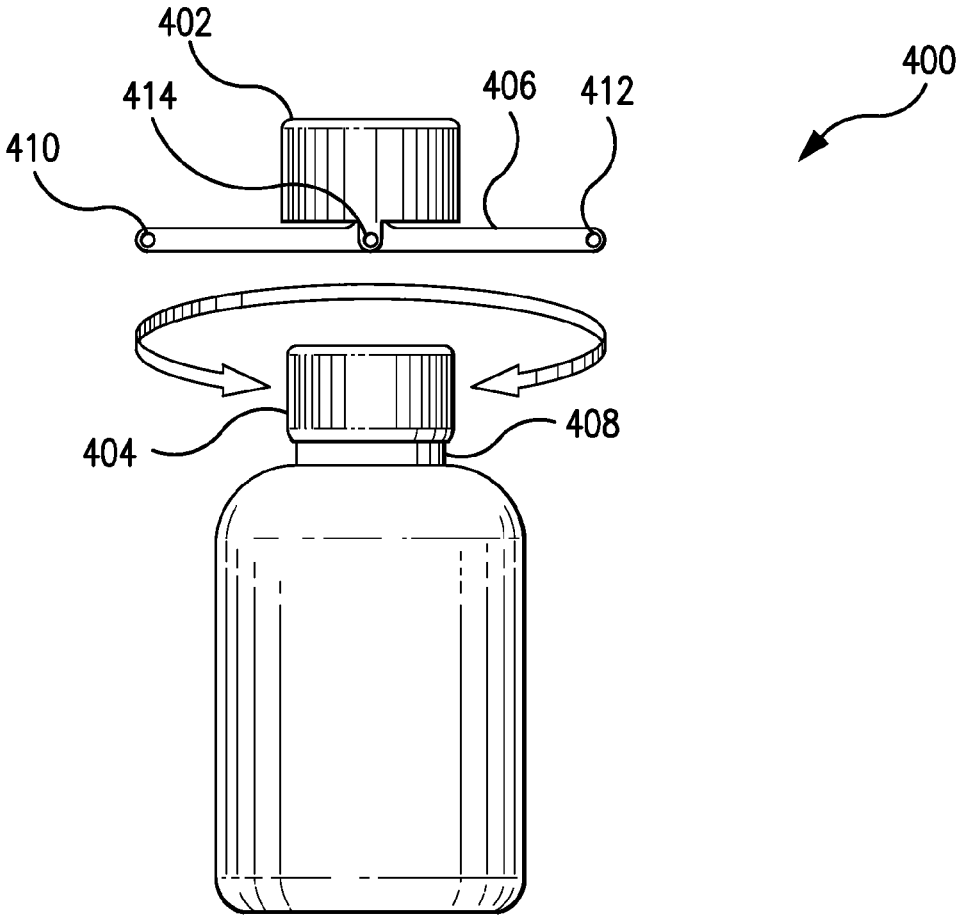
FIG. 4 is an exploded front view of the container and primary cap shown in FIG. 2 and the secondary cap shown in FIG. 3.
Figure 5:
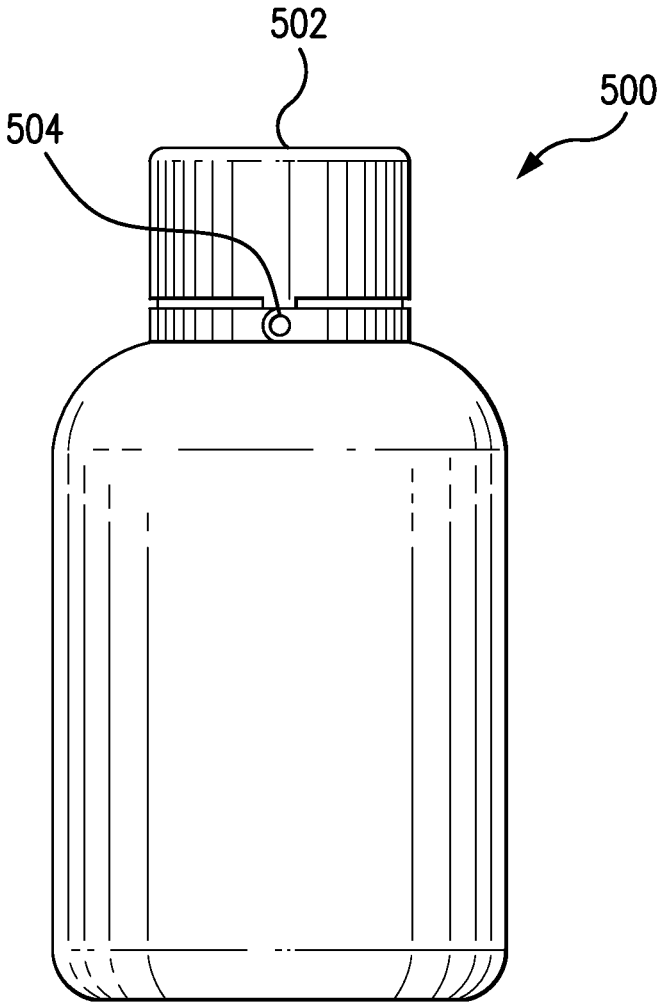
FIG. 5 is a front view of a package including the secondary cap shown in FIG. 3 positioned over the primary cap on the container shown in FIG. 2.

For purposes of illustration and not limitation, the secondary cap further includes a strap extending therefrom. The strap is configured to secure the secondary cap to the container. For example, and as shown in FIGS. 3-5, the strap 304 extends from the secondary cap and has a length sufficient to extend about a perimeter of the rim of the container. The strap 304 has a first end portion 306 with a first aperture 308 therein and a second end portion 310 with a second aperture 312 therein. The secondary cap also includes an intermediate portion 314 extending from the cover with a third aperture 316 therein. The intermediate portion 314 is located such that the first, second and third apertures are aligned with each other when the strap 304 is extended securely about the rim of the container. The strap can be integral with the secondary cap, such as made with a single-piece construction. Alternatively, the strap can be formed separately of the same or different material as the secondary cap and attached thereto in a fixed manner. Other structural members capable of securing the secondary cap in position over the primary cap likewise can be used in addition to or in lieu of a strap.

With reference to FIG. 4, the secondary cap 402 is positioned over the primary cap 404 to prevent the removal of the primary cap 404. The strap 406 of the secondary cap is extended securely about the rim 408 to align the first aperture 410, the second aperture 412, and the third aperture 414. FIG. 5 shows the package 500 after the secondary cap 502 has been positioned over the primary cap. The first aperture, second aperture, and third aperture are aligned at position 504.

Figure 6:
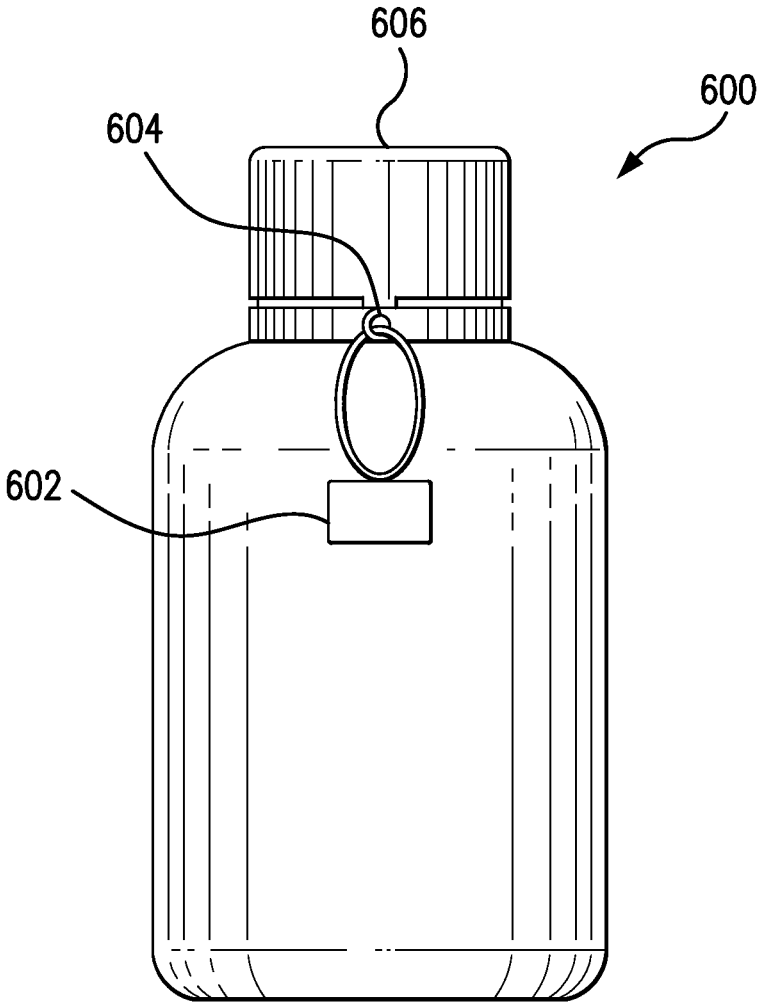
FIG. 6 is a front view of the package shown in FIG. 5 with the secondary cap shown in FIG. 3 secured over the primary cap shown in FIG. 2 using a representative embodiment of a single-use lock in accordance with the disclosed subject matter.

With reference to FIG. 6, a single-use lock 602 is received by the aligned apertures 604 to secure the secondary cap 606 in position over the primary cap. In order to access the primary cap, it is therefore necessary to damage or remove the single-use lock 602, which provides evidence that someone has accessed or tampered with the container. In an exemplary embodiment, the single-use lock is a cable tie. However, the disclosed subject matter includes any suitable single-use lock for its intended purpose as known in the art. Furthermore, the single-use lock can be secured to or otherwise integral with the secondary cap rather than being formed as a separate member.

The single-use lock can be made of any suitable material. The material can be chosen with reference to the particular shipping and/or storage requirements for the particular product and package. For example, if the container is freeze-thawed, the material for the single-use lock should be chosen such that the single-use lock does not degrade during freeze-thawing.

In an exemplary embodiment, the single-use lock contains an identifier that cannot easily be replicated to ensure that the single-use lock cannot be removed and replaced with a copy. The identifier can include a serial number, a hologram, a watermark, a bar code, a radio frequency identification tag, an integrated circuit chip, a combination of the foregoing elements, or any suitable identifier for its intended purpose as known in the prior art. The unique information can be verified at the location of delivery to ensure that no one has tampered with the package.

In accordance with one embodiment of the disclosed subject matter, the single-use lock secures the secondary cap in position over the primary cap by trapping at least a first end portion of the strap underneath the primary cap. In this embodiment, the primary cap is larger than the perimeter of the rim of the container. The strap is secured about the perimeter of the rim by the single-use lock such that the area enclosed by the strap is less than the area required to maneuver the strap over the primary cap. Furthermore, if a fastener or similar protrusion extends from the rim, the strap preferably is positioned below the fastener or protrusion to further assist in securing the secondary cap to the container.

Figure 8:
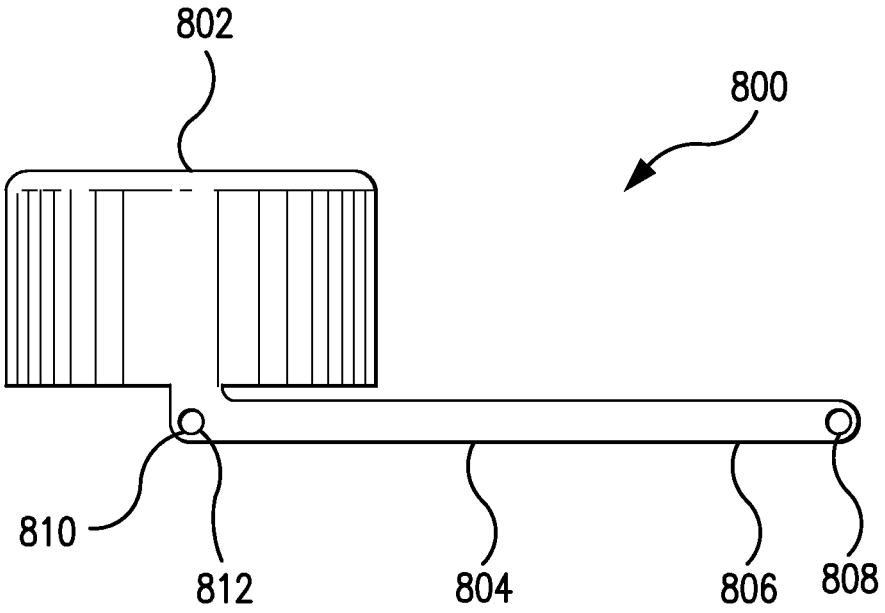
FIG. 8 is a front view of an alternative embodiment of a secondary cap in accordance with the disclosed subject matter.

Alternative embodiments of the secondary cap also can be used. For example, and with reference to FIG. 8, another embodiment of the secondary cap 800 in accordance with the disclosed subject matter is shown. The secondary cap 800 includes a cover 802 and a strap 804 extending therefrom. The strap 804 has an end portion 806 with a first aperture 808 therein and a second portion 810 with a second aperture 812 therein. The second aperture 810 can be located at the base of the strap proximate a location wherein the strap extends from the cover 802 or the second aperture can be located along a length of the strap—provided the distance between the first aperture 808 and the second aperture 812 is sufficient for the strap to extend about a perimeter of the rim of the container. To secure the secondary cap 800 in position over the primary cap, the first aperture and the second aperture are aligned to form an aligned aperture. The single-use lock can then be inserted through the aligned aperture to secure the secondary cap in position over the primary cap. Additionally and/or alternatively, the single-use lock can be secured to and extend from the secondary cap at or proximate the location of aperture 812.

Figure 9:
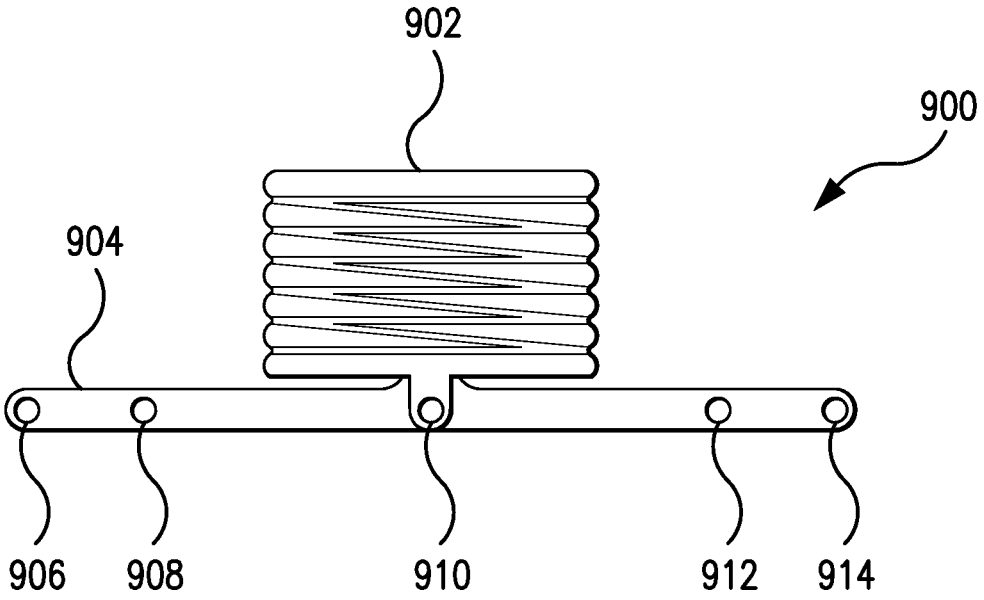
FIG. 9 is a front view of another embodiment of a secondary cap including a flexible cover and a variable length strap.

In accordance with another aspect of the disclosed subject matter, the secondary cap can be configured for use with primary caps and containers of a variety or range of shapes and sizes. For example, and as embodied herein, the cover of the secondary cap can made of a flexible material or otherwise configured to expand (e.g., expansion joints) over a desired range of sizes. Additionally, or alternatively, the strap of the secondary cap can be provided or configured with a variable-length. For purpose of illustration and not limitation, FIG. 9 illustrates a representative embodiment of a secondary cap 900 having both an expandable cover 902 and an adjustable length strap 904. Flexible cover 902 is configured to accommodate a range of primary caps of different sizes. For example, flexible cover 902 can be constructed of a durable flexible material that can be wrapped over the primary cap, or more particularly, an elastic material capable of being stretched over the primary cover. Alternatively, expansion joints or similar features (e.g., accordion or bellows type joints) can be provided or formed in the secondary cover to enable the desired expansion. Preferably, however, the cover is reinforced or otherwise configured to inhibit or prevent expansion along the base of the cover. For example, the strap of the cover can be joined along a greater length of the base or joined at a plurality of locations along the base of the cover. In this manner, the flexible cover of the disclosed subject matter can be expanded to accommodate variety of sizes of the primary cap.

As further illustrated in FIG. 9, the strap of the secondary cap can be configured with a variable length. The variable-length strap allows the secondary cap to accommodate a variety of peripheral or circumferential dimensions about the rim of the container. That is, the strap can have at least two secured strap lengths. As used herein, secured strap length refers to the length of the closed loop formed when the strap is extended securely around the rim of the container. For example, and as embodied herein with reference to FIG. 9, the strap 904 includes a plurality of spaced apertures 906, 908, 912, and 914. Additionally, although not necessarily, one or more additional apertures 910 can be formed in an intermediate portion extending from the cover 902. The plurality of apertures allows a number of secured strap lengths to be defined or formed in use. For example, a first secured strap length is defined when aperture 906 is aligned with aperture 912 and a second greater secured strap length is defined when aperture 906 is aligned with aperture 914. Likewise, if aperture 910 is provided, then a third secured strap length is defined when apertures 908 and 912 are aligned therewith, and a greater secured strap length is defined when apertures 906 and 914 are aligned therewith. Providing additional apertures and/or aligning other combinations of apertures (e.g., 908 and 914) allow for additional secured strap lengths. Additional strap lengths could be obtained by using additional apertures and by varying the distances between the apertures.

After the package has arrived at its destination and the presence of the single-use lock confirms that no one has tampered with the package, the single-use lock can be removed. In an exemplary embodiment, the single-use lock is a cable tie and the secondary cap can easily be removed by cutting and removing the cable tie.

Figure 7:
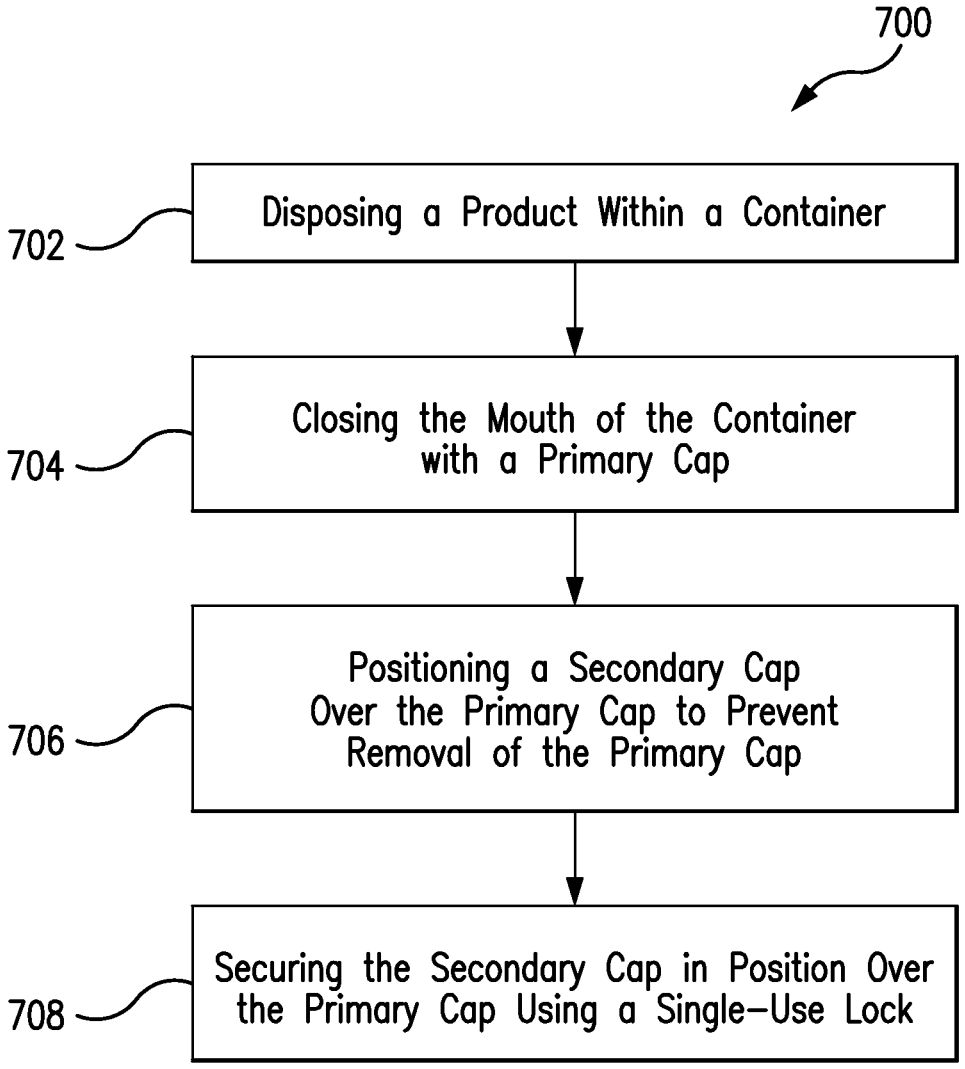
FIG. 7 is a flow chart describing a representative embodiment of a method of packaging a product in a tamper-evident manner in accordance with the disclosed subject matter.

With reference to FIG. 7, an exemplary method of packaging a product in a tamper-evident manner is disclosed. A product is disposed within the container (See 702). The product can be a health care product, including pharmaceutical, biological, and nutritional products. Such products can come in any of a variety of forms such as a pill, capsule, tablet, solid crystal, liquid, powder, or any other dosage form suitable for its intended purpose as known in the art. However, the disclosed subject matter may also be used with a wide variety of other products.

Additionally the container can be sealed before or after placement of the primary cap. For example, a seal can be placed over the mouth of the container before the primary cap is attached to the container. The seal can be a foil seal, although any suitable seal for its intended purpose as known in the art can be used in accordance with the disclosed subject matter. The seal can be a security seal for additional protection against potential tampering, and can include printed indicia that cannot be easily reproduced. The seal can be an airtight seal if it is desirable or necessary to keep the stored product in an airtight environment. Additionally or alternatively, an overwrap or the like can be disposed over the primary cap before placement of the secondary cap thereover.

The mouth of the container is closed with a primary cap removably-attachable to the rim of the container (See 704). In an exemplary embodiment, as noted above for illustration and not limitation, the rim of the container includes a fastener extending outwardly from the rim and the primary cap includes a mating fastener. For example, the fastener can be a threaded fastener and the primary cap can be a screw cap. The primary cap is attached to the rim of the container by fastening the fastener of the rim to the mating fastener of the primary cap. While a threaded fastener and a screw cap are presented as an exemplary embodiment, the primary cap of the disclosed subject matter may be removably attached to the rim of the container using any suitable method for its intended purpose as known in the art.

A secondary cap is positioned over the primary cap to prevent removal of the primary cap (See 706). Once the secondary cap has been positioned over the primary cap, the primary cap cannot be accessed until the secondary cap is removed.

The secondary cap is secured in position over the primary cap using a single-use lock (See 708). In an exemplary embodiment, the secondary cap can be secured in position using a strap which extends about the perimeter of the rim of the container. As embodied therein, the strap has a length sufficient to extend about the perimeter of the rim. For example, and in accordance with one embodiment, the strap includes a first aperture to receive a single-use lock. The strap can also include a second aperture, wherein the first aperture and second aperture can be aligned to form an aligned aperture when the strap is extended securely about the rim, and the single-use lock is inserted through the aligned aperture to secure the secondary cap in position over the primary cap.

In accordance with another embodiment, as previously described with reference to FIGS. 1-6, the secondary cap can have three apertures which are aligned when the strap is extended about the perimeter of the rim of the container. Additionally, or alternatively, the secondary cap can have a flexible configuration and/or variable-length strap as described with reference to FIG. 9. In each of the embodiments, with the secondary cap properly positioned over the primary cap, the aligned apertures receive a single-use lock to secure the secondary cap in position over the primary cap. To access the primary cap, the single-use lock therefore must be damaged or removed, which provides an indication that someone have accessed or tampered with the container.

While the present application is described herein in terms of certain preferred embodiments, those skilled in the art will recognize that various modifications and improvements may be made to the application without departing from the scope thereof. Thus, it is intended that the present application include modifications and variations that are within the scope of the appended claims and their equivalents. Moreover, although individual features of one embodiment of the application may be discussed herein or shown in the drawings of one embodiment and not in other embodiments, it should be apparent that individual features of one embodiment may be combined with one or more features of another embodiment or features from a plurality of embodiments.

In addition to the specific embodiments claimed below, the application is also directed to other embodiments having any other possible combination of the dependent features claimed below and those disclosed above. As such, the particular features presented in the dependent claims and disclosed above can be combined with each other in other manners within the scope of the application such that the application should be recognized as also specifically directed to other embodiments having any other possible combinations. Thus, the foregoing description of specific embodiments of the application has been presented for purposes of illustration and description. It is not intended to be exhaustive or to limit the application to those embodiments disclosed.

The invention claimed is:

1. A package having a tamper-evident feature, the package comprising:

a container having a sidewall defining a chamber and a rim defining a mouth to the chamber;

a primary cap removably-attachable to the rim of the container to selectively close the mouth of the container; and a secondary cap positioned over the primary cap to prevent removal of the primary cap when positioned thereover, wherein said secondary cap includes a strap extending therefrom, said strap having a length sufficient to extend about a perimeter of the rim of the container to secure the secondary cap to the container by a single-use lock, wherein the strap includes a first aperture to receive the single use lock, and wherein the strap includes a first free portion with the first aperture therein and a second free end portion with a second aperture therein, and the secondary cap further comprises an intermediate portion with a third aperture therein, the first, second and third apertures being aligned with each other when the strap is extended securely about the rim to receive the single use lock therethrough.

2. The package of claim 1, further comprising a health care product contained within the chamber.

3. The package of claim 1, wherein the rim includes a fastener extending outwardly from the rim for removable attachment of the primary cap.

4. The package of claim 3, wherein the fastener of the rim is a threaded fastener.

5. The package of claim 1, wherein the single-use lock is a cable tie.

6. The package of claim 2, wherein the health care product is a pharmaceutical, biological, or nutritional product.

7. The package of claim 2, wherein the health care product is in the form of pills, capsules, tablets, solid crystals, a powder, or a liquid.

8. A method of packaging a product in a tamper-evident manner comprising:

disposing a product within a container having a sidewall defining a chamber and a rim defining a mouth to the chamber;

closing the mouth of the container with a primary cap removably-attachable to the rim of the container; and positioning a secondary cap over the primary cap to prevent removal of the primary cap, wherein the secondary cap includes a strap extending therefrom that has a length sufficient to extend about a perimeter of the rim;

securing the secondary cap in position over the primary cap by extending the strap about the perimeter of the rim of the container and using a single-use lock, wherein the strap includes a first aperture to receive the single use lock, and wherein the strap includes a first free portion with the first aperture therein and a second free end portion with a second aperture therein, and the secondary cap further comprises an intermediate portion with a third aperture therein, and further wherein securing the secondary cap in position over the primary cap includes:

aligning the first aperture, the second aperture, and the third aperture with each other with the strap extending securely about the rim; and inserting the single-use lock through the first aperture, the second aperture, and the third aperture to secure the secondary cap in position over the primary cap.

9. The method of claim 8, wherein the product is a health care product.

10. The method of claim 8, wherein the rim comprises a fastener extending outwardly from the rim for removable attachment of the primary cap.

11. The method of claim 10, wherein the fastener of the rim is a threaded fastener.

12. The method of claim 8, wherein the single-use lock is a cable tie.

13. The method of claim 9, wherein the health care product is a pharmaceutical, biological, or nutritional product.

14. The method of claim 9, wherein the health care product is in the form of pills, capsules, tablets, solid crystals, a powder, or a liquid.

* * * * *